US009636735B2

(12) United States Patent
Hansen et al.

(10) Patent No.: US 9,636,735 B2
(45) Date of Patent: May 2, 2017

(54) HOT DIE FORMING ASSEMBLY AND METHOD OF MAKING A HEAT TREATED PART

(71) Applicants: Monty Lynn Hansen, Sterling Heights, MI (US); James Donald Metz, Chicago, IL (US); MAGNA INTERNATIONAL INC., Aurora, Ontario (CA)

(72) Inventors: Monty Lynn Hansen, Sterling Heights, MI (US); James Donald Metz, Chicago, IL (US)

(73) Assignee: Magna International Inc. (CA)

( * ) Notice: Subject to any disclaimer, the term of this patent is extended or adjusted under 35 U.S.C. 154(b) by 0 days.

(21) Appl. No.: 14/765,086

(22) PCT Filed: Feb. 4, 2014

(86) PCT No.: PCT/US2014/014589
§ 371 (c)(1),
(2) Date: Jul. 31, 2015

(87) PCT Pub. No.: WO2014/123855
PCT Pub. Date: Aug. 14, 2014

(65) Prior Publication Data

US 2016/0001342 A1 Jan. 7, 2016

Related U.S. Application Data

(60) Provisional application No. 61/761,265, filed on Feb. 6, 2013.

(51) Int. Cl.

| | |
|---|---|
| ***B21D 22/02*** | (2006.01) |
| ***B21D 37/16*** | (2006.01) |
| ***C21D 1/673*** | (2006.01) |

(52) U.S. Cl.
CPC ..... *B21D 22/02* (2013.01); *B21D 22/022* (2013.01); *B21D 37/16* (2013.01); *C21D 1/673* (2013.01); *C21D 2221/00* (2013.01)

(58) Field of Classification Search
CPC .... B21D 22/02; B21D 22/022; B21D 22/208; B21D 24/16; B21D 37/16; C21D 1/673; C21D 2221/00
See application file for complete search history.

(56) References Cited

U.S. PATENT DOCUMENTS

| | | | |
|---|---|---|---|
| 3,294,597 | A | 12/1966 | Kuchera |
| 2006/0185774 | A1 | 8/2006 | Nishibata et al. |

(Continued)

FOREIGN PATENT DOCUMENTS

| | | | | |
|---|---|---|---|---|
| DE | WO 2012010418 | A1 * | 1/2012 | ..... B21D 22/06 |
| GB | 1490535 | | 11/1977 | |
| WO | 2011160209 | A1 | 12/2011 | |

*Primary Examiner* — Teresa M Ekiert
(74) *Attorney, Agent, or Firm* — Dickinson Wright PLLC

(57) ABSTRACT

A method of making a part is provided. A blank is loaded into a die assembly having a pair of shoes with forming pieces attached thereto and compressible members sandwiched between the shoes and the forming pieces. The die is closed about the blank to deform the blank into a part. The die is then opened by a predetermined distance while at least one of the compressible members deforms elastically to maintain contact between at least one of the forming pieces and the part. Less than the entire surface of the part is then conductively cooled through the at least one forming piece to provide a predetermined portion of the part with a predetermined microstructure.

11 Claims, 6 Drawing Sheets

(56) References Cited

U.S. PATENT DOCUMENTS

| | | | | |
|---|---|---|---|---|
| 2011/0000613 | A1 | 1/2011 | Cigallio et al. | |
| 2013/0205863 | A1* | 8/2013 | Loesch ..... | B21D 22/06 72/342.7 |

* cited by examiner

HOT DIE FORMING ASSEMBLY AND METHOD OF MAKING A HEAT TREATED PART

CROSS-REFERENCE TO PRIOR APPLICATIONS

This U.S. National Stage patent application claims the benefit of PCT International Patent Application Serial No. PCT/US2014/014589 filed Feb. 4, 2014 entitled "Hot Die Forming Assembly And Method Of Making A Heat Treated Part," which claims the benefit of U.S. Provisional Patent Application Ser. No. 61/761,265 filed Feb. 6, 2013, entitled "Hot Die Forming Assembly And Method Of Making A Heat Treated Part," the entire disclosures of the applications being considered part of the disclosure of this application and hereby incorporated by reference.

BACKGROUND OF THE INVENTION

1. Field of the Invention

The present invention is related generally to shaping and heat treating parts.

2. Related Art

The manufacture of many metal parts, such as automotive parts, requires both shaping and heat treating operations. Various types of shaping operations include, for example, stamping, extruding, machining, roll forming, hydro forming, etc. Heat treating operations typically include heating the part to a predetermined temperature, such as an austenite transformation temperature, and cooling the part at a predetermined rate. The cooling rate chosen will affect the microstructure of the metal and thus the mechanical properties of the part.

One particular type of shaping operation includes placing a metal blank into a die assembly and closing a pair of dies having patterns around the blank to deform the blank into a workpiece having a predetermined shape. Next, the dies are separated from one another and the workpiece is removed from the die assembly. After removal from the die assembly, the workpiece is heat treated to provide it with a desired microstructure.

SUMMARY OF THE INVENTION

One aspect of the present invention includes a method of making a workpiece. The method includes the step of preparing a die assembly including a pair of dies, wherein at least one of the dies has a shoe, a plurality of forming pieces operably coupled with the shoe, and at least one compressible member which is sandwiched between the shoe and at least one of the forming pieces. The method proceeds with the step of positioning a blank in the die assembly between the pair of dies. The method continues with the step of moving at least one of the dies towards the other die. The method proceeds with the step of compressing the at least one compressible member to move at least one of the forming pieces relative to another of the forming piece. The method continues with the step of deforming the blank with the plurality of forming dies. The method proceeds with the step of separating the pair of dies by a predetermined distance such that at least one of the forming pieces disengages from the deformed blank while the at least one compressible member expands to maintain at least one of the forming pieces in engagement with the deformed blank. The method further includes the step of conductively cooling less than the entire surface of the deformed blank with the at least one forming piece in engagement with the deformed blank after separating the pair of dies by the predetermined distance.

The same equipment to be used to both shape and heat treat predetermined portions of the blank. This allows for reduced manufacturing time and improved cost effectiveness in the manufacturing of the part.

According to another aspect of the present invention, the method further includes the steps of moving at least one of the dies towards the other die to engage all of the forming pieces with the deformed workpiece after the step of conductively cooling less than the entire surface of the deformed workpiece and conductively cooling substantially the entire surface of the deformed workpiece. This is advantageous because it allows for heat treating of substantially the entire part within the die assembly. Additionally, closing the die assembly has the effect of compensating for any deformations in the workpiece that may arise from uneven cooling.

Another aspect of the present invention provides for a forming assembly for shaping a blank into a workpiece. The forming assembly includes a pair of dies that are moveable towards and away from one another. At least one of the dies has a shoe and a plurality of forming pieces operably coupled with the shoe and at least one compressible member that is sandwiched between the shoe and at least one of the forming pieces. The at least one compressible member is of a material that is elastically deformable for allowing at least one of the forming pieces to move relative to an adjacent forming piece. The at least one die with the forming piece further includes a cooling system for extracting heat from the workpiece.

BRIEF DESCRIPTION OF THE DRAWINGS

These and other features and advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
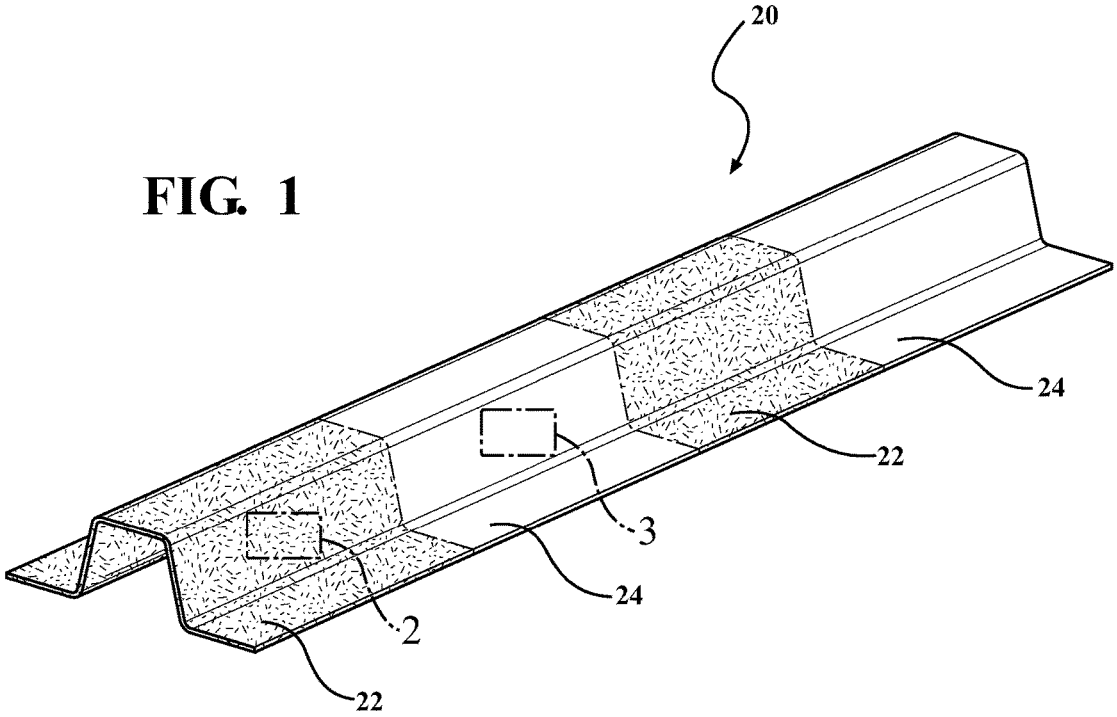
FIG. 1 is a perspective elevation view of an exemplary part.
Figure 2:
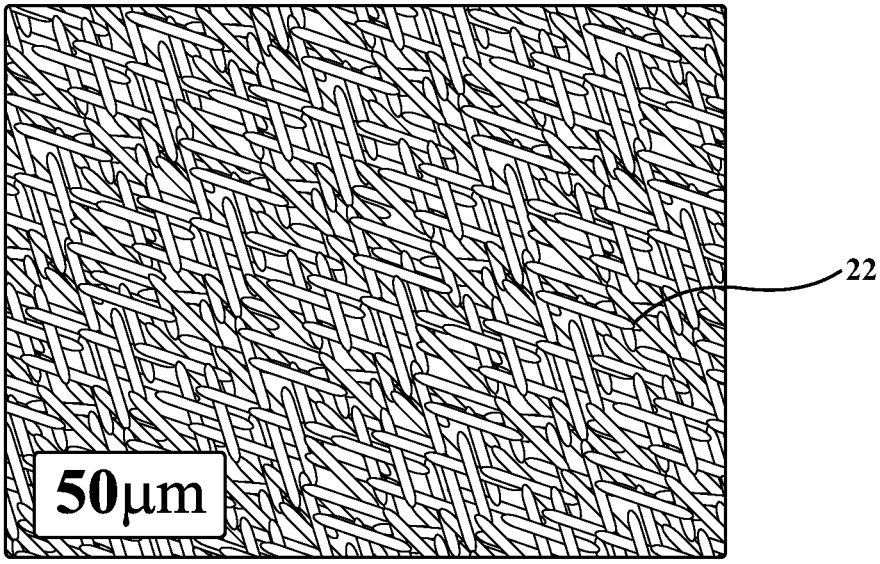
FIG. 2 is an enlarged view showing the microstructure of a portion of the part shown in FIG. 1.
Figure 3:
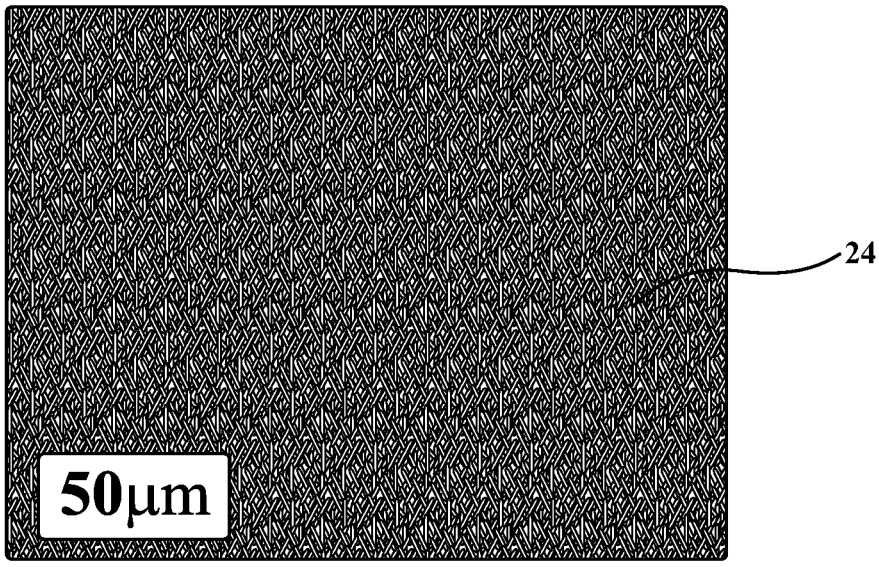
FIG. 3 is an enlarged view showing the microstructure of a different portion of the part shown in FIG. 1.

Referring to the Figures, wherein like numerals indicate corresponding parts throughout the several views, an exemplary embodiment of a one-piece, stamped automotive part 20 (or workpiece) made of steel or a steel alloy is generally shown in FIG. 1. As shown in FIGS. 1-3, the exemplary automotive part 20 is broken into a plurality of portions 22, 24 or areas with differing metallurgical microstructures. Specifically, the exemplary part 20 includes two portions 22 (hereinafter referred to as "untempered portions") which are spaced from one another and have a first microstructure and two portions 24 (hereinafter referred to as "tempered portions") which are spaced from one another and have a second microstructure that is different than the first microstructure. In the exemplary automotive part 20, the first microstructure of the untempered portions 22 is untempered martensite (shown in FIG. 2) and the second microstructure of the tempered portions 24 is tempered martensite (shown in FIG. 3). The different microstructures provide the untempered and tempered portions 22, 24 with differing mechanical properties or characteristics, thereby allowing the part 20 to be optimized for a particular application. The locations, geometries, and specific microstructures of the different portions 22, 24 on the part 20 may be chosen based on the intended application of the part 20. For example, the tempered portions 24 may be located in areas of the part 20 where increased toughness is desired, and the untempered portions 22 may be located in areas of the part 20 where increased hardness is desired. As discussed in further detail below, the part 20 could also be provided with any desirable number of differing microstructures, and the specific microstructures could be any combination of, for example, martensite, tempered martensite, bainite, pearlite, etc. The part 20 could be, for example, an A-pillar, a B-pillar, or a C-pillar of an automobile body or a control arm of a suspension system or a range of other automotive or non-automotive components.

Figure 4:
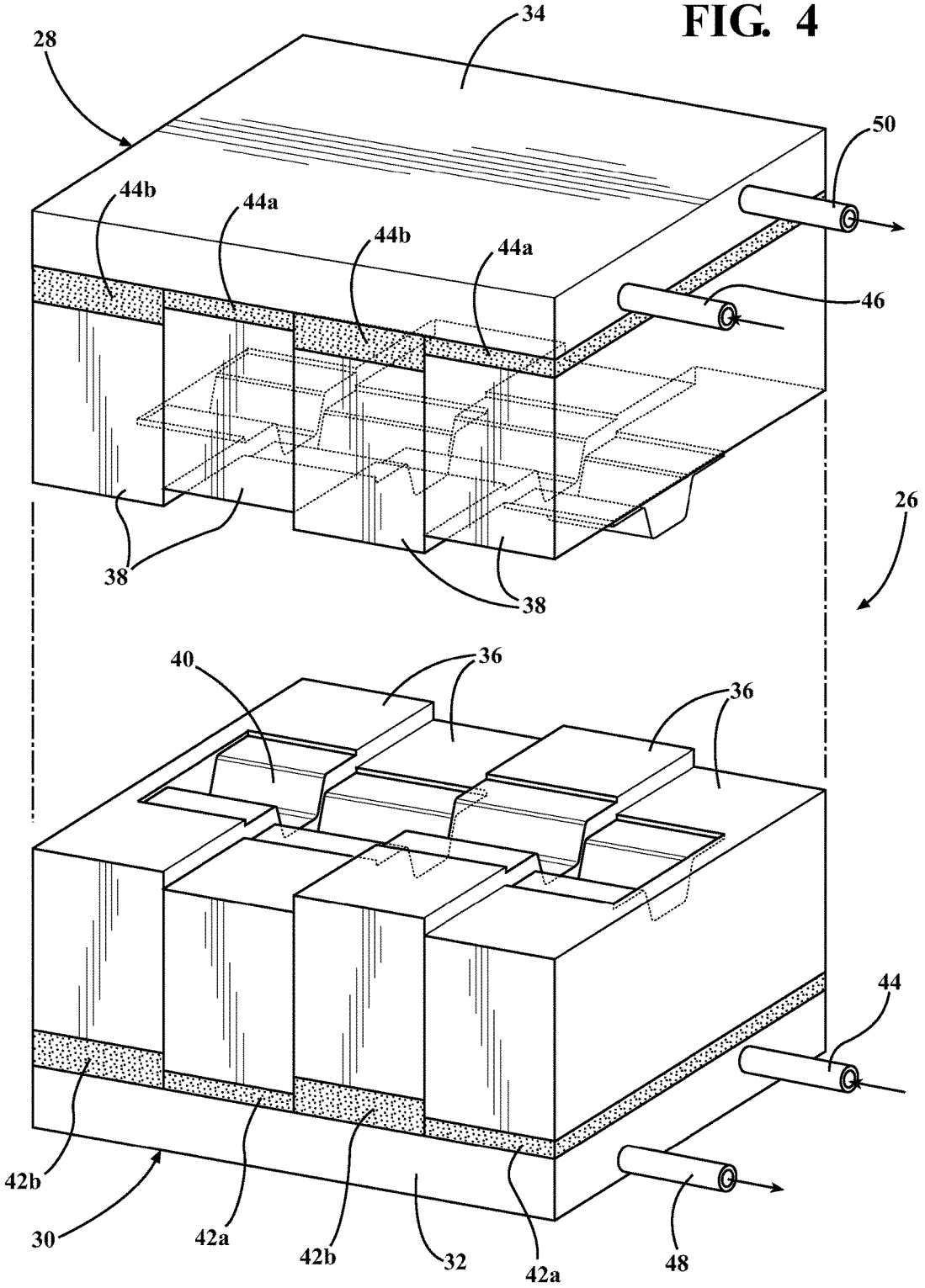
FIG. 4 is a perspective view of an exemplary die assembly having a pair of dies that are in open positions.

The untempered and tempered portions 22, 24 are formed into the one-piece part 20 during and immediately following a stamping process on a die assembly 26, and using the same die assembly 26 as is used for the stamping process. Referring now to FIG. 4, the exemplary embodiment of the die assembly 26 includes an upper die 28 and a lower die 30 which are moveable relative to one another between open positions (shown in FIG. 4), closed positions (shown in FIG. 6) and intermediate positions (shown in FIG. 7). Each of the dies 28, 30 has a shoe 32, 34 and a plurality of forming pieces 36, 38, and each of the forming pieces 36, 38 has a forming surface which faces away from the respective shoe 32, 34. As shown, the forming surfaces cooperate with one another to present a cavity 40 for shaping a blank into the part 20. In the exemplary embodiment, the forming pieces 36, 38 of each die 28, 30 have similar heights. However, it should be appreciated that forming pieces with differing heights could alternately be employed.

Figure 5:
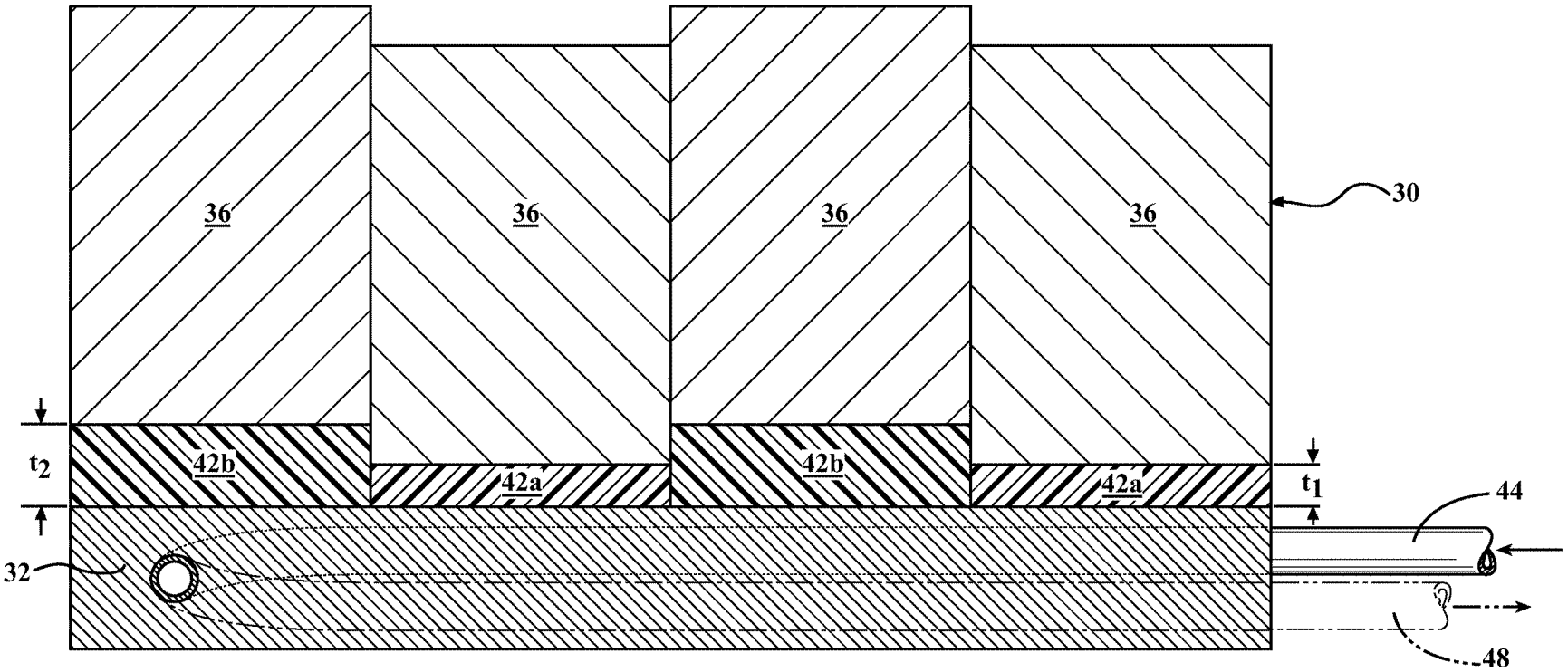
FIG. 5 is a cross-sectional view of one of the dies of the die assembly shown in FIG. 4.

A plurality of compressible members 42, 44 or discs made of an elastically compressible material (such as neoprene) or hydraulic or pneumatic cylinders are sandwiched between the shoes 32, 34 and the respective forming pieces 36, 38 for allowing movement of the forming pieces 36, 38 relative to one another during operation of the die assembly 26, as discussed in further detail below. Referring now to FIG. 5, when the lower die 30 is in the open position, two of the compressible members 42*a* (hereinafter "thin compressible members 42*a*") have a first thickness $t_1$ and two of the compressible members 42*b* (hereinafter "thick compressible members 42*b*") have a second thickness $t_2$ which is greater than the first thickness $t_1$. As such, because the forming pieces 36 have similar heights, when the lower die 30 is in the open position, the forming surfaces of the forming pieces 36 joined with the thin compressible members 42*a* are relatively lower than or recessed relative to the forming surfaces of the forming pieces 36 joined with the thick compressible members 42*b*. In other words, there are steps between adjacent forming surfaces, and the heights of the steps correspond with the difference in the thicknesses of the thin and thick compressible members 42*a*, 42*b*. It should also be appreciated that one or more (but not all) of the forming pieces could be directly attached to either of the shoes or attached thereto without a compressible member sandwiched therebetween.

In the exemplary embodiment, the compressible members 42, 44 are formed of a rubber material with a high thermal conductivity. However, it should be appreciated that the compressible members 42, 44 could alternately be formed of any suitably elastically compressible material. The compressible members 42, 44 could also be formed of different materials.

Referring back to FIG. 4, each of the shoes 32, 34 has an inlet 44, 46 for receiving a coolant, an outlet 48, 50 for dispensing the coolant out of the respective shoe 32, 34, and a coolant passage extending therebetween. As will be discussed in further detail below, during operation of the die assembly 26, a coolant, such as water, therethrough to selectively cool or heat treat the part 20 after a shaping process is completed.

Figure 6:
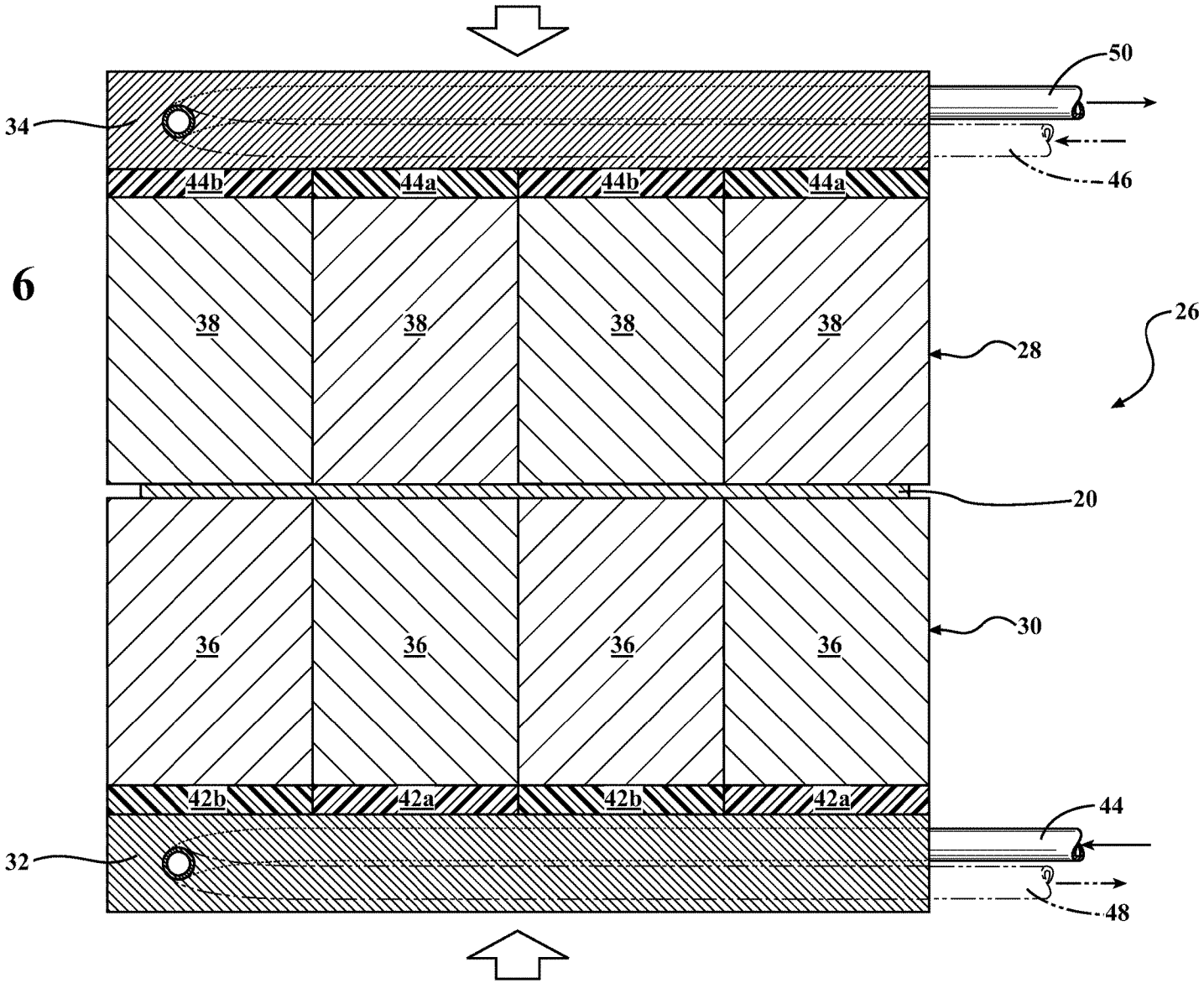
FIG. 6 is a cross-sectional view of the dies of FIG. 4 in closed positions.
Figure 7:
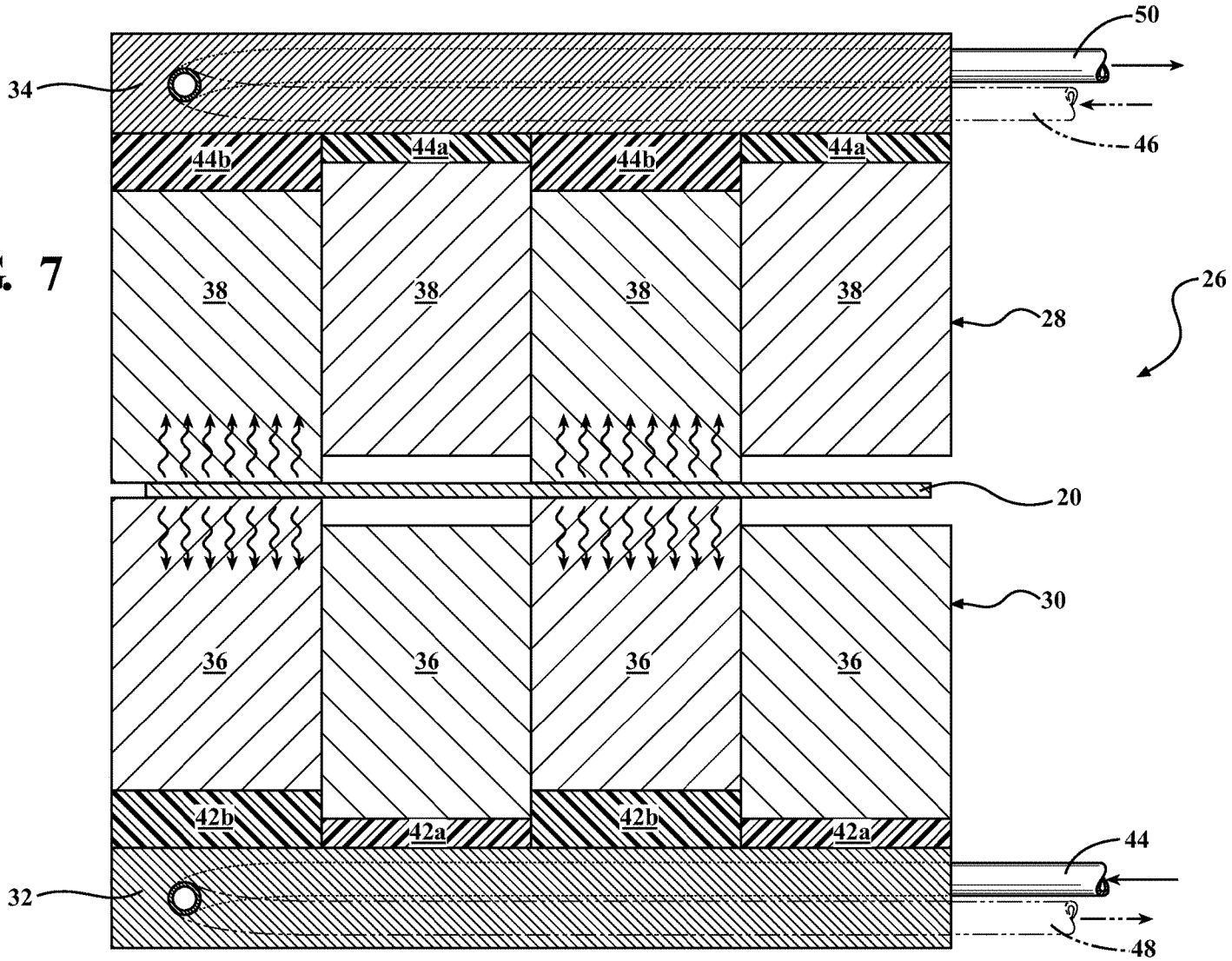
FIG. 7 is a cross-sectional view of the dies of FIG. 4 in intermediate positions.

The process of shaping and heat treating a metal blank to form a part, such as the part 20 shown in FIGS. 1-3, begins with heating the blank to a predetermined temperature, such as for example, greater than five hundred degrees Celsius (500° C.) or the austenite temperature of the material, which is approximately 730° C. for steel. Next, as shown in FIG. 6, the upper and lower dies 28, 30 are moved together to sandwich the blank 20 between the forming surfaces of the forming pieces 36, 38 and deform the blank 20 until it conforms to the shape of the cavity 40 (shown in FIG. 4). As shown, during the deformation process, the thick compressible members 42*b*, 44*b* deflect or compress by a greater distance than the thin compressible members 42*a*, 44*a*, thereby negating the steps between the forming surfaces of the adjacent forming pieces 36, 38 and allows for a generally smooth part 20 without steps to be formed. In the exemplary embodiment, all four of the forming pieces 36, 38 are in abutting engagement with the blank 20 during the deforming process.

During or immediately following the deformation of the blank 20 in the cavity 40 of the die assembly 26, the part 20 is heat treated between the upper and lower dies 28, 30 to provide the material of the part 20 with predetermined microstructures and mechanical properties. The heat treating process includes separating the upper and lower dies 28, 30 from one another by a predetermined distance such that the thick compressible members 42*b*, 44*b* elastically expand by a greater distance than the thin compressible members 42*a*, 44*a* to maintain the forming pieces 36, 38 coupled with the thick compressible members 42*b*, 44*b* in contact with the part 20 while the other forming pieces 36, 38 separate therefrom.

A coolant is then channeled through the shoes 32, 34 of the upper and lower dies 28, 30, and heat is transferred conductively from the shaped part 20, through the forming pieces 36, 38 that remain in contact therewith, through the thick compressible members 42*b*, 44*b* and into the shoe 32, 34 where it is extracted from the die assembly 26 by the coolant. As such, when the upper and lower dies 28, 30 are in the intermediate positions shown in FIG. 7 the portions of the shaped part 20 which remain in contact with the forming pieces 36, 38 are cooled at a relatively quicker rate than the other portions of the shaped part 20. In the exemplary embodiment, heat is extracted from the part 20 at a predetermined rate to form untempered martensite microstructure in these portions. However, by, for example, altering the flow of coolant through the shoes 32, 34, the specific microstructures formed by the heat treating process can be modified.

After the portions that remain in contact with the forming pieces 36, 38 cool to a predetermined temperature (e.g., 300° C.) and after a predetermined duration of time, the upper and lower dies 28, 30 are then moved back towards one another to the positions shown in FIG. 6 to bring the separated forming pieces 36, 38 back into contact with the shaped part 20. Heat is now also extracted from the portions of the shaped part 20 in engagement with the forming pieces 36, 38 that are coupled with the thin compressible members 42*a*, 44*a* to form these portions into a tempered martensite microstructure. In addition to further cooling the part 20, re-closing the die assembly 26 provides the additional benefit of removing any dimensional issues in the part 20 that may have developed during the uneven cooling process.

It should be appreciated that the upper and lower dies 28, 30 could be selectively moved together and separated at predetermined intervals to selectively cool the shaped part, thereby forming a range of different microstructures other than just tempered and untempered martensite.

Another aspect of the present invention is related to a method of making a part. The method includes the step of preparing a die assembly 26 including a pair of dies 28, 30, wherein at least one (and preferably both) of the dies 28, 30 has a shoe 32, 34; a plurality of forming pieces 36, 38 operably coupled with the shoe 32, 34; and at least one compressible member 42, 44 which is sandwiched between the shoe 32, 34 and at least one of the forming pieces 36, 38. In the exemplary embodiment, each of the dies 28, 30 has a plurality of thin compressible members 42*a*, 44*a* with a first thickness $t_1$ and a plurality of thick compressible members 42*b*, 44*b* with a second thickness $t_2$ that is greater than the first thickness $t_1$.

The method continues with the step of positioning a blank 20 in the die assembly 26 between the upper and lower dies 28, 30. The method proceeds with the steps of moving at least one of the dies 28, 30 towards the other die 28, 30 and compressing the at least one compressible member 42, 44 to move at least one of the forming pieces 36, 38 relative to another adjacent forming piece 36, 38. The method proceeds with the step of compressing the at least one compressible member 42, 44 to move at least one of the forming pieces 36, 38 relative to another forming piece 36, 38. The method proceeds with the step of deforming the blank 20 with the plurality of forming pieces 36, 38. The method continues with the step of separating the upper and lower dies 28, 30 by a predetermined distance such that at least one of the forming pieces 36, 38 disengages from the deformed blank 20 while the at least one compressible member 42, 44 expands to maintain at least one of the forming pieces 36, 38 in engagement with the deformed blank 20. The method proceeds with the step of cooling the deformed blank 20 with the at least one forming piece 36, 38 in engagement with the deformed blank 20 after separating the pair of dies 28, 30 by the predetermined distance.

In the exemplary method, the at least one compressible member 42, 44 includes at least one thin compressible member 42*a*, 44*a* sandwiched between the shoe 32, 34 and at least one thick compressible member 42*b*, 44*b* and wherein during the separation of the upper and lower dies 28, 30, the at least one forming piece 36, 38 in connection with the at least one thin compressible member 42*a* separates from the deformed blank 20 and the at least one forming piece 36, 38 in connection with the at least one thick compressible member 42*b*, 44*b* remains in contact with the deformed blank 20.

In the exemplary method, the shoe 32, 34 includes a cooling channel for conveying a cooling fluid to cool the forming pieces 36, 38 after the step of deforming the blank 20.

The compressible members 42, 44 are preferably of a material having a high thermal conductivity.

The exemplary method further includes the step of heating the blank 20 before the step of moving at least one of the dies 28, 30 towards the other die 28, 30.

The exemplary method still further includes the steps of moving at least one of the dies 28, 30 towards the other die 28, 30 to engage all of the forming pieces 36, 38 with the deformed blank 20 after the step of conductively cooling less than the entire surface of the deformed blank 20 and conductively cooling substantially the entire surface of the deformed blank 20.

Obviously, many modifications and variations of the present invention are possible in light of the above teachings and may be practiced otherwise than as specifically described while within the scope of the appended claims.

The invention claimed is:

1. A method of making a workpiece, comprising the steps of:

preparing a die assembly including a pair of dies, at least one of the dies having a shoe, a plurality of forming pieces operably coupled with the shoe, and at least one compressible member made of a thermally conductive material sandwiched between the shoe and at least one of the forming pieces;

positioning a metal blank in the die assembly and between the pair of dies;

moving at least one of the dies towards the other die;

compressing the at least one compressible member to move at least one of the forming pieces relative to another forming piece;

deforming the blank with the plurality of forming pieces;

separating the pair of dies by a predetermined distance such that at least one of the forming pieces disengages from the deformed blank while the at least one compressible member expands to maintain at least one of the forming pieces in engagement with the deformed blank; and conductively cooling a portion of the surface of the deformed blank with the at least one forming piece in engagement with the deformed blank after separating the pair of dies by the predetermined distance such that the conductively cooled portion of the deformed blank acquires a different microstructure than the remainder of the deformed blank.

2. The method as set forth in claim 1 wherein the at least one forming die includes at least one thick compressible member sandwiched between the shoe and at least one of the forming pieces and at least one thin compressible member sandwiched between the shoe and at least one of the other forming pieces and wherein during the separating of the dies, the at least one forming piece in connection with the at least one thin compressible member separates from the deformed blank and the at least one forming piece in connection with the at least one thick compressible member remains in contact with the deformed blank.

3. The method as set forth in claim 2 wherein the shoe includes a cooling channel for receiving a cooling fluid to cool the forming pieces after the step of deforming the blank.

4. The method as set forth in claim 1 wherein each of the dies has a shoe and a plurality of forming pieces which are operably coupled with the shoe and at least one compressible member sandwiched between the shoe and at least one of the forming pieces.

5. The method as set forth in claim 1 further including the steps of moving at least one of the dies towards the other die to engage all of the forming pieces with the deformed blank after the step of conductively cooling less than the entire surface of the deformed blank and conductively cooling substantially the entire surface of the deformed blank.

6. The method as set forth in claim 1 further including the step of heating the blank to a predetermined temperature before the step of moving at least one of the dies towards the other die.

7. The method as set forth in claim 6 wherein the predetermined temperature is an austenite transformation temperature.

8. A forming assembly for shaping a blank into a workpiece, comprising:

a pair of dies that are moveable towards and away from one another;

at least one of said dies having a shoe and a plurality of forming pieces that are made as separate pieces from said shoe and are operably coupled with said shoe and having at least one compressible member sandwiched between said shoe and at least one of said forming pieces;

said at least one compressible member being of a material that is elastically deformable for allowing at least one of said forming pieces to move relative to an adjacent forming piece; and said at least one of said dies with said at least one compressible member having a cooling system in said shoe for cooling a workpiece.

9. The forming assembly as set forth in claim 8 wherein said at least one compressible member is of a material that has a high thermally conductivity for conveying heat from the workpiece through said at least one forming piece and through said at least one compressible member to said shoe.

10. The forming assembly as set forth in claim 8 wherein each of said dies includes a shoe and a plurality of forming pieces operably coupled with said shoe and at least one compressible member sandwiched between said shoe and at least one of said forming pieces.

11. A forming assembly for shaping a blank into a workpiece, comprising:

a pair of dies that are moveable towards and away from one another;

at least one of said dies having a shoe and a plurality of forming pieces that are made as separate pieces from said shoe and are operably coupled with said shoe and having at least one compressible member sandwiched between said shoe and at least one of said forming pieces;

said at least one compressible member being of a material that is elastically deformable for allowing at least one of said forming pieces to move relative to an adjacent forming piece;

said at least one of said dies with said at least one compressible member having a cooling system for cooling a workpiece; and wherein said at least one compressible member is further defined as a plurality of compressible members including at least one thin compressible member having a first thickness and at least one thick compressible member having a second thickness that is greater than said first thickness.

* * * * *